US005145477A

United States Patent [19]

Han

[11] Patent Number: 5,145,477

[45] Date of Patent: Sep. 8, 1992

[54] SPRING SADDLE CYCLE

[76] Inventor: Sihui Han, 3800 Pepperell Pkwy., Opelika, Ala. 36801

[21] Appl. No.: 818,558

[22] Filed: Jan. 9, 1992

[51] Int. Cl.[5] ..... A63B 22/06

[52] U.S. Cl. ..... 482/57; 482/121

[58] Field of Search ..... 482/57, 62, 63, 148, 482/51, 121, 129

[56] References Cited

U.S. PATENT DOCUMENTS

| | | | |
|---|---|---|---|
| 1,872,256 | 8/1932 | Denney | 482/62 |
| 2,348,747 | 5/1944 | Newman | 482/121 |
| 3,432,164 | 3/1969 | Deeks | 482/63 |

*Primary Examiner*—Stephen R. Crow

[57] ABSTRACT

A spring saddle cycle for fitness as well as for amusement is provided. The spring saddle cycle consists of a spring saddle and a pedal drive. The spring saddle includes a spring, a cycle saddle and handle bar or a simulative form of animal, such as horse. The pedal drive includes a pedal crankshaft connected at the both ends of the spring with a connecting rod and two brackets. The positions of the seat and the pedal drive and the length of the connecting rod are adjustable for the variable needs of the riders with the different body weight and the different pressure on the pedals. Several embodiments of the spring saddle cycle are provided.

9 Claims, 2 Drawing Sheets

SPRING SADDLE CYCLE

FIELD OF THE INVENTION

This invention relates to an exercise and amusement riding equipment, particularly to a spring saddle cycle which can be applied as a pedal cycle exercise equipment for all age of people as well as a riding toy for children.

BACKGROUND OF THE INVENTION

Pedal cycle exercise equipment is widely used as a fitness equipment, which has a rotary wheel with a brake device and is driven by a chain through pedals. However, it is dangerous to operate with the high speed rotating wheel and the chain, particularly for children, and the construction is complicated and voluminous.

Spring saddle is widely used as playground amusement equipment for children, which is equipped by a spring supported seat with some simulative form of animals, such as horse, pony, porpoise, etc. It is operated by shifting occupant's weight to produce movement of the seat and to reproduce the characters of the simulation of riding toy. Accordingly, the conventional spring saddle suffers from the disadvantages of monotonous functioning and poor performance. The occupant has to shift the whole body to produce the movement which can not reproduce well the characters of the simulative animals of riding so that the rider becomes easily bored. Further, it can not give a good exercise to children as the occupant's feet just put on the seat while riding. Also, it is almost just used as outdoor playground equipment, as the rider has to shift the whole body to move the seat around, it is not stable to use a portable base for indoor application,

SUMMARY OF THE INVENTION

Accordingly, it is desirable to provide a exercise as well as amusement equipment which can have the advantages of both the cycle fitness equipment and the spring saddle amusement equipment, and can eliminate all the above mentioned disadvantages.

Objects and advantages of the present invention are:

(a) to provide a pedal cycle exercise equipment for all age of people, which does not use any rotary wheel with brake device and chain, and is not only effective and easy to use, but also simple and inexpensive for manufacturing, and also safety for practical use.

(b) to provide a riding toy for use by children, which can be easily operated outdoor and indoor, produces an exciting functioning, reproduces well the characters of the simulative forms of riding toy, and give a good exercise to children as a fitness equipment as well.

Basically, this invention consists of a combination of a spring saddle and a pedal drive without any rotary wheel, brake device and chain. The spring saddle has a spring, a cycle saddle and a handle bar or a simulative form of animal, such as horse. The pedal drive has a crankshaft with two rotatable pedals at each end of the crankshaft. The crankshaft is connected to the both ends of the springs with two brackets and a connecting rod which includes a bearing holder, a bushing rod and an adjustable pipe.

In the present invention, a preferred embodiment of spring saddle cycle is first provided in illustration of the invention and its application for fitness equipment, and then some preferred embodiments of the invention are provided in illustration of the applications for amusement equipments.

DESCRIPTION OF THE INVENTION

Figure 1:
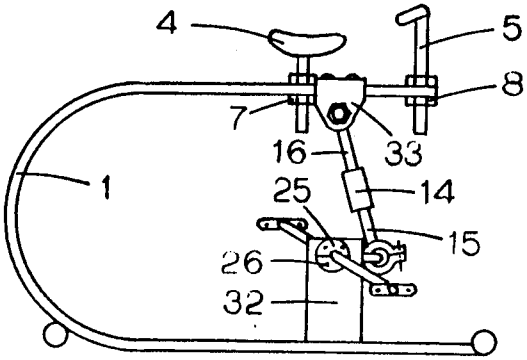
FIG. 1 is a side view of the spring saddle cycle for fitness equipment.
Figure 2:
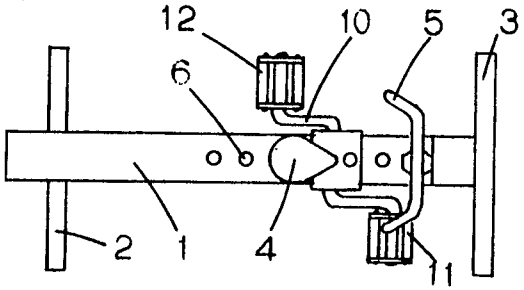
FIG. 2 is a top side view of the spring saddle cycle for fitness equipment.

A preferred embodiment of the spring saddle cycle for fitness equipment is shown in FIG. 1–2 for a side and top side view respectively.

The spring saddle cycle comprises basically a spring saddle and a pedal drive. The spring saddle comprises a "C" shape spring 1, a base including a front bar 3 and a rear bar 2 which are fixed with the spring 1, a cycle saddle 4 and handle bar 5 which are adjustable for their heights and positions on the spring 1 with locknuts 7 and 8.

The pedal drive has a crankshaft 10 with two rotatable pedals 11 and 12 at each end of the crankshaft 10. The crankshaft 10 is connected to the both ends of the springs 1 with two brackets 32 and 33 and a connecting rod which includes a bearing holder 15, a bushing rod 16 and an adjustable pipe 14.

Two lines of holes 6 are located on the top and bottom portions of the spring, so that the positions of the seat 4, the handle bar 5 and the pedal drive with the two brackets 32 and 33 can be adjustable for the variable needs of the rider.

Figure 3:
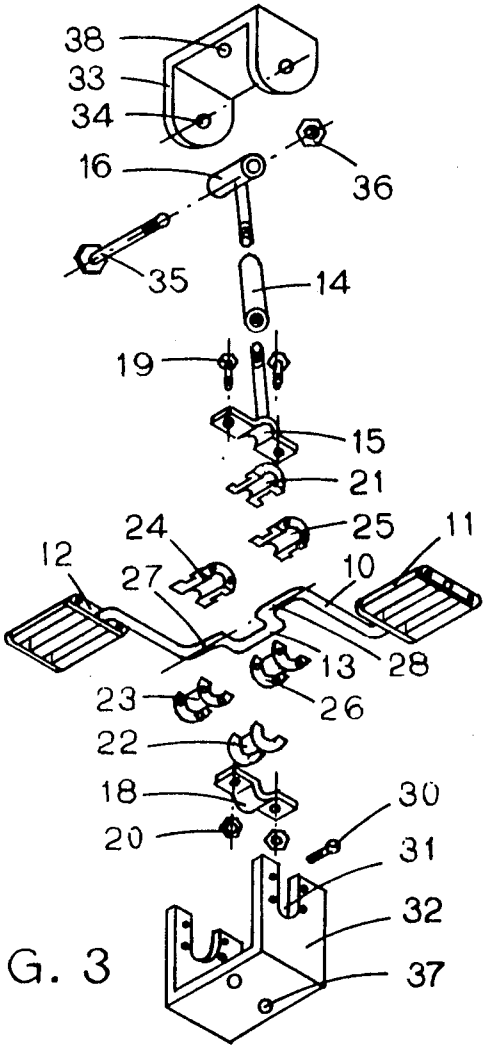
FIG. 3 is an exploded perspective view for the pedal drive of the spring saddle cycle.

FIG. 3 shows a detail exploded perspective view for the pedal drive. The pedal drive has a crankshaft 10 which has two rotatable pedals 11 and 12 at the both ends of the crankshaft 10. At the middle portion of the shaft 10, there is a crank 13.

A connecting rod which includes a bearing holder 15, a bushing rod 16 and an adjustable pipe 14 connects the crank 13 and the bushing bracket 33. On the ends of the rod portions of the bearing holder 15 and the bushing rod 16, there are some threads which fit the threads inside the adjustable pipe 14 so that the length of the connecting rod is adjustable by turning the adjustable pipe 14. The connecting rod fastens to the crankshaft 10 with a rod cap 18 which is fixed with bolts 19 and nuts 20 with the connecting rod, so that the cap 19 is removable to allow the connecting rod to be connected to or disconnected from the crankshaft 10.

One half-split crank bearing 21 is inserted into the bearing holder 15 and another half-split crank bearing 2 is inserted into the rod cap 18. The crank bearings 21 and 22 fit the connecting rod journal portion 13. By the both sides of the crank bearings 21 and 22, four main bearings 23–26 which are half-split type of bearings too fit the shaft main journals 27 and 28 of the crankshaft 10.

The main bearings 23–26 fasten with bolts 30 to the bearing bracket 32 which is fixed on the spring 1.

A slot 31 is made on each vertical portion of the bearing bracket 32 so that the main bearings 23–26 can be connected to and disconnected from the crankshaft main journals 27 and 28. The connecting rod connects the bushing bracket 33 with a pin 35 and a nut 36 through the bushing rod 16 and the holes 34 on the both vertical portions of the bushing bracket 33 so that the connecting rod is rotatable.

Other preferred embodiments are shown in FIG. 4–8 for examples as riding toys for children by using a seat with a simulative form of animal such as horse and by using a "C" shape spring, a "O" shape spring, a coil spring, a cone spring and two cone springs respectively.

Figure 4:
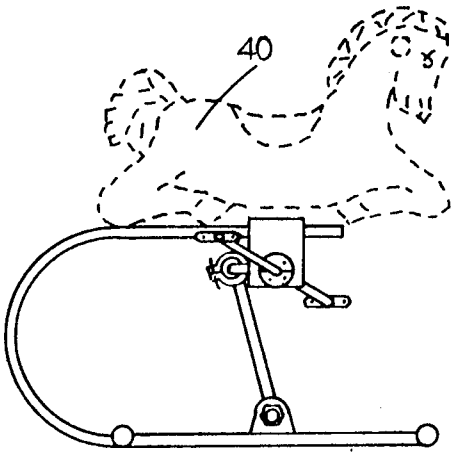
FIG. 4 is a side view of the spring saddle cycle with a "C" shape spring.

In an embodiment shown in FIG. 4, a seat with a simulative form of animal, such as a horse 40, is fixed on the top side of the "C" shape spring. The pedal drive assembly is inversely mounted on the ends of the spring so that children can pedal easily.

Figure 5:
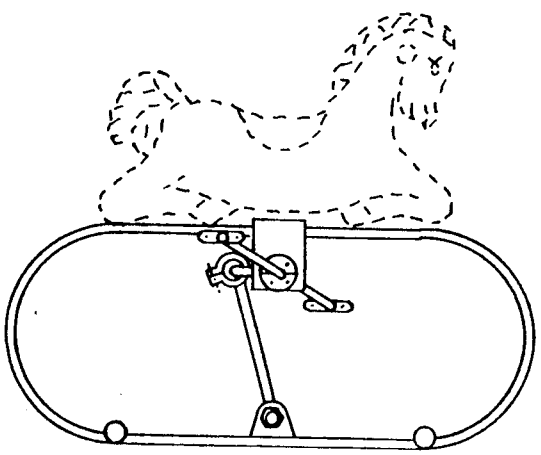
FIG. 5 is a side view of the spring saddle cycle with a "O" shape spring.

In an embodiment shown in FIG. 5, an "O" shape spring is used instead of the "C" shape spring shown in FIG. 4, so that the embodiment has more stability.

Figure 6:
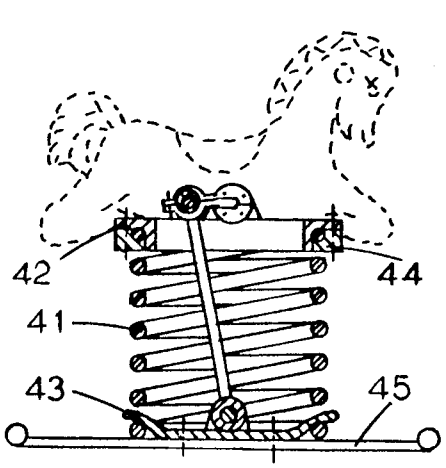
FIG. 6 is a side view of the spring saddle cycle with a coil spring.

In an embodiment shown in FIG. 6, the pedal drive assembly is mounted inside the coil spring 41 and fixed with a hanger 42 on the top end of the spring. The hanger 42 is connected with the main bearings 23–26 and fastens to the spring 41 with a top mount casting 44. The bottom end of the spring 41 is fixed to the base 45 with a bottom mount casting 43.

Figure 7:
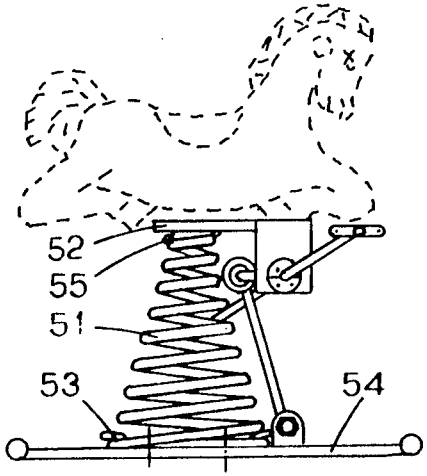
FIG. 7 is a side view of the spring saddle cycle with a cone spring.

In an embodiment shown in FIG. 7, a cone shape coil spring 51 is used and fixed to a platform 52 with a top mount casting 55 on the top side of the spring 51 and to the base 54 with a bottom mount casting 53 on the bottom of the spring 51. The pedal drive is mounted by the side of the spring 41, instead of inside the spring as shown in FIG. 6.

Figure 8:
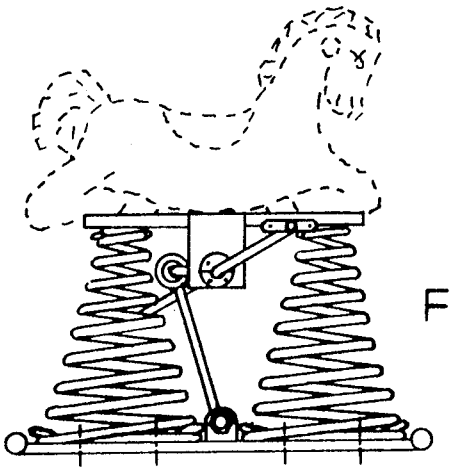
FIG. 8 is a side view of the saddle cycle with two cone springs.

In an embodiment shown in FIG. 8, two cone shape coil springs are used on the front and rear sides of the pedal drive, instead of using only one cone spring as shown in FIG. 7, so that the embodiment has more stability.

While operating, a rider is seating on the seat with the feet on the pedals of the cycle drive. During rider's pedaling, the rotary motion of the feet is translated by the crankshaft into a reciprocating motion, and the spring would then be alternatively depressed and returned due to the length changes of the pedal drive. With the rotation of the crankshaft, the seat on the spring moves up and down and swings back and forth, which reproduces well the jumping and running characters of the simulative animal, so that it gives the rider an exciting movement as an amusement mean.

To move the rider up and down as well as back and forth, the occupant has to apply a force on the pedals for overcoming the resistance from the whole body's weight and movement so that it gives a good exercise to the rider as a fitness equipment.

The rider can adjust the length of the connecting rod by turning the adjustable pipe and can change the positions of the seat and the pedal drive by changing the holes on the spring as shown in FIG. 1 and 2, so that the rider can adjust the compression inside the spring to meet the needs for the variable rider's body weight and different pressure on the pedals.

CONCLUSION AND SCOPE

The above description of the invention provides a novel and useful means for entertainment as well as for fitness for a wide range of age riders. The present invention is by no means limited to the specific showing in the drawings and description of the preferred embodiments, but also encompasses any exemplification of the combination from a spring saddle and the pedal drive within the scope of the invention. Following then, are some examples of possible variations on the invention:

Two or more spring saddles and pedal drives can be grouped in parallel or in series within one unit of the equipment to allow two or more people to operate simultaneously.

The applications could be indoor or outdoor. For the outdoor application as playground recreational means, the equipment can be fixed directly on the ground without the base in the drawings.

The spring could be replaced by a spring made by other type of material, for instance, made by elastomer rubber material instead of the metallic spring.

I claim:

1. A spring saddle cycle as a fitness and amusement equipment, said spring saddle cycle comprising:

at least one spring saddle for supporting at least one occupant and for operation by the occupant(s), said spring saddle including a spring, a seat and a base, said seat mounted on the top of said spring, said base mounted on the bottom of said spring;

at least one pedal drive for producing the movement of said seat for the occupant(s), said pedal drive including a crankshaft, a connecting rod, a bearing bracket and a bushing bracket:

wherein said crankshaft having two rotatable pedals at each end of said crankshaft, a crank at the middle portion of said crankshaft, said crank fitted to two half-split crank bearings, two main journals by each side of said crank, each said main journal fitted to two half-split main bearings;

wherein said connecting rod having a bearing holder, said bearing holder inserted into with said crank bearings and fixed to a rod cap for connecting to said crank, an adjustable pipe, said adjustable pipe having threads inside and fitting with said bearing holder and a bushing rod for adjusting the length of said pedal drive;

wherein said bearing bracket has two vertical portions which each has a bearing slot, said bearing slot each received in and fixed with two half-slit said main bearings, said bearing bracket mounted on said spring;

wherein said bushing bracket has two vertical portions which each has a pin hole, said bushing rod connected to said bushing bracket with a pin through said pin hole and said bushing rod.

2. A spring saddle cycle as set forth in claim 1 wherein said pedal cycle can be inversely mounted between the both ends of said spring.

3. A spring saddle cycle as set forth in claim 1 wherein said seat includes a cycle saddle and a handle bar, said cycle saddle and said handle bar are adjustable for their heights and positions on said spring.

4. A spring saddle cycle as set forth in claim 1 wherein said seat includes a simulative form of animal, such as horse.

5. A spring saddle cycle as set forth in claim 1 wherein said spring is a "C" shape spring, and a line of holes are made on the top and bottom sides of said "C" shape spring to connect and adjust said pedal drive.

6. A spring saddle cycle as set forth in claim 1 wherein said spring is a "O" shape spring, and a line of holes are made on the top and bottom sides of said "0" shape spring to connect and adjust said pedal drive.

7. A spring saddle cycle as set forth in claim 1 wherein said spring is a coil spring, said pedal drive is mounted inside of said spring with a hanger and a top mount casting on the top side of said spring and a bottom mount casting on the bottom side of said spring.

8. A spring saddle cycle as set forth in claim 1 wherein said spring includes a first spring, said pedal drive is mounted by the side of said first spring with a hanger and a first top mount casting on the top side of said first spring and a first bottom mount casting on the bottom side of said first spring.

9. A spring saddle cycle as set forth in claim 7 further comprising a second spring, a second top mount casting, and a second bottom mount casting, and said pedal drive is mounted between said first spring and said second spring.

* * * * *